US011611160B2

(12) United States Patent
De Cloet et al.

(10) Patent No.: US 11,611,160 B2
(45) Date of Patent: Mar. 21, 2023

(54) ROBUST, HIGH FREQUENCY-SUITABLE ELECTRICAL TERMINAL

(71) Applicant: TE Connectivity Germany GmbH, Bensheim (DE)

(72) Inventors: Olivier De Cloet, Bensheim (DE); Wolfgang Mueller, Bensheim (DE); Jochen Brandt, Woert (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 17/192,955

(22) Filed: Mar. 5, 2021

(65) Prior Publication Data

US 2021/0280991 A1 Sep. 9, 2021

(30) Foreign Application Priority Data

Mar. 5, 2020 (DE) ..... 10 2020 105 994.9

(51) Int. Cl.
*H01R 4/18* (2006.01)
*H01R 24/40* (2011.01)

(52) U.S. Cl.
CPC ..... *H01R 4/185* (2013.01); *H01R 24/40* (2013.01)

(58) Field of Classification Search
CPC ..... H01R 4/185; H01R 24/40
USPC ..... 439/585
See application file for complete search history.

(56) References Cited

U.S. PATENT DOCUMENTS 4,010,538 A * 3/1977 O'Keefe ..... H01R 9/0518 29/865
4,178,054 A * 12/1979 Laudig ..... H01R 9/0518 439/424
4,453,796 A * 6/1984 Monroe ..... H01R 9/0518 439/585
5,145,409 A * 9/1992 Sato ..... H01R 9/0518 D13/133
5,246,384 A * 9/1993 Sato ..... H01R 9/0518 439/585
5,603,636 A * 2/1997 Kanou ..... H01R 43/0482 439/585
6,065,998 A * 5/2000 Peloza ..... H01R 9/0518 439/578
6,482,034 B2 * 11/2002 Ozaki ..... H01R 4/188 439/585
6,951,483 B2 * 10/2005 Kameyama ..... H01R 9/0518 439/99

(Continued)

FOREIGN PATENT DOCUMENTS

CN 203277712 U 6/2013
DE 102018003665 A1 7/2019
EP 0000996 A1 8/1978

OTHER PUBLICATIONS

English translation of CN203277712, dated Jun. 11, 2013, 1 p.

(Continued)

*Primary Examiner* — Peter G Leigh
(74) *Attorney, Agent, or Firm* — Barley Snyder

(57) ABSTRACT

An electrical terminal includes a contacting section and a crimping section arranged to a rear of the contacting section in an axial direction of the terminal. A first material layer of the crimping section is crimped directly onto a second material layer of the terminal or of the crimping section in a crimped state, forming a double material layer region.

20 Claims, 4 Drawing Sheets

(56) References Cited

U.S. PATENT DOCUMENTS

| | | | | |
|---|---|---|---|---|
| 7,140,914 | B2 * | 11/2006 | Kojima | H01R 4/185 439/585 |
| 7,867,027 | B2 * | 1/2011 | Sakaguchi | H01R 4/184 439/585 |
| 9,325,082 | B2 * | 4/2016 | Furukawa | H01R 9/0518 |
| 9,509,067 | B2 * | 11/2016 | Yamauchi | H01R 9/0518 |
| 2004/0203286 | A1 | 10/2004 | Kameyama | |
| 2005/0266727 | A1 * | 12/2005 | Yamaguchi | H01R 9/0518 439/585 |
| 2006/0089046 | A1 * | 4/2006 | Annequin | H01R 43/048 439/578 |
| 2015/0364843 | A1 | 12/2015 | Yamauchi et al. | |

OTHER PUBLICATIONS

Abstract of DE102018003665, dated Jul. 11, 2019, 1 p.
Extended European search report in EP Appln. No. 21161045.6-1201, dated Jul. 20, 2021, 10 pp.

* cited by examiner

ROBUST, HIGH FREQUENCY-SUITABLE ELECTRICAL TERMINAL

CROSS-REFERENCE TO RELATED APPLICATIONS

This application claims the benefit of the filing date under 35 U.S.C. § 119(a)-(d) of German Patent Application No. 10 2020 105 994.9, filed on Mar. 5, 2020.

FIELD OF THE INVENTION

The present invention relates to an electrical terminal and, more particularly, to an electrical terminal embodied as a shielding contact sleeve.

BACKGROUND

In the electrical sector (electronic engineering, electrical engineering, electrics, electrical energy technology etc.), a large number of electrical connector apparatuses or connector facilities, female connectors, male connectors and/or hybrid connectors etc.—referred to below as (electrical) connectors (also: mating connectors)—are known, which are used for transmitting electrical currents, voltages, signals and/or data with a broad spectrum of currents, voltages, frequencies and/or data rates. In the low, medium or high voltage range and/or low, medium or high current range and in particular in the automotive sector, it is necessary for such connectors in mechanically loaded, warm, possibly hot, contaminated, moist and/or chemically aggressive environments, long-term, repeatedly and/or after a comparatively long period of inactivity to ensure at short notice a transmission of electrical power, signals and/or data. Due to a broad spectrum of applications, a large number of specially configured connectors are known.

Such a connector and where appropriate its associated (for example in the case of a connector apparatus) or superordinate (for example in the case of a connector assembly) housing can be installed on an electrical line, a cable, a wiring harness etc.—referred to below as a pre-assembled (electrical) cable (also: electrical entity)—, or on/in an electrical assembly or apparatus, such as for example on/in a housing, on/onto a lead frame, on/onto a printed circuit board etc., of a (power) electrical, electro-optical or electronic component or a corresponding aggregation etc. (electrical entity).

If a connector (with/without a housing) is located on a cable, a line or a wiring harness, then this is also referred to as a flylead (male) connector or a male connector, a female connector or a coupling; if said connector is located on/in an electrical, electro-optical or electronic component, aggregation etc. then this is also referred to as a connector assembly, such as for example a (mounting/add-on) connector, a (mounting/add-on) male connector or a (mounting/add-on) female connector. Moreover, a connector on such a assembly is often also referred to as a (male connector) receiving device, pin socket, pin strip or header. Within the scope of electrical energy technology (generation, conversion, storage, transport and transmission of high voltage electrical currents in electrical networks preferably with alternating current-high voltage transmission), this is referred to here as cable fittings owing to their comparatively complex construction.

Such a connector must ensure a faultless transmission of electricity, whereby mutually corresponding and in part complementary connectors (connectors and mating connectors) mainly comprise locking facilities and/or attaching facilities for permanently but generally releasably locking and/or attaching the connector on/in the mating connector or vice versa. Moreover, an electrical connecting assembly for a connector, for example having or comprising an actual contact apparatus (terminal; mainly embodied in one piece as far as the material is concerned or integral thereto, for example a contact element etc.) or a contact assembly (terminal; mainly multi-part, two-part, one piece, embodied in one piece as far as the material is concerned or integral thereto, for example a one piece or multi-part (crimp) contact assembly), must be reliably received therein. In the case of a (pre)assembled electrical cable, such a connecting assembly can be provided as a connector, in other words without a housing, for example a flylead connector.

Efforts are constantly being made to improve electrical connectors and their terminals, in particular owing to miniaturization to embody them in a more robust manner, to render them more effective and to produce them in a more cost-effective manner. In this case, other rules than in the case of conventional data connectors (definition here: transmission frequencies lower than approx. 3 MHz) apply for high frequency data connectors (HF: high frequency, definition here transmission frequencies higher than 3 to higher than 300 MHz and clearly into the GHz range (approx. 150 GHz)), since in high frequency technology in particular the wave characteristics of electricity manifest themselves.

SUMMARY

An electrical terminal includes a contacting section and a crimping section arranged to a rear of the contacting section in an axial direction of the terminal. A first material layer of the crimping section is crimped directly onto a second material layer of the terminal or of the crimping section in a crimped state, forming a double material layer region.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
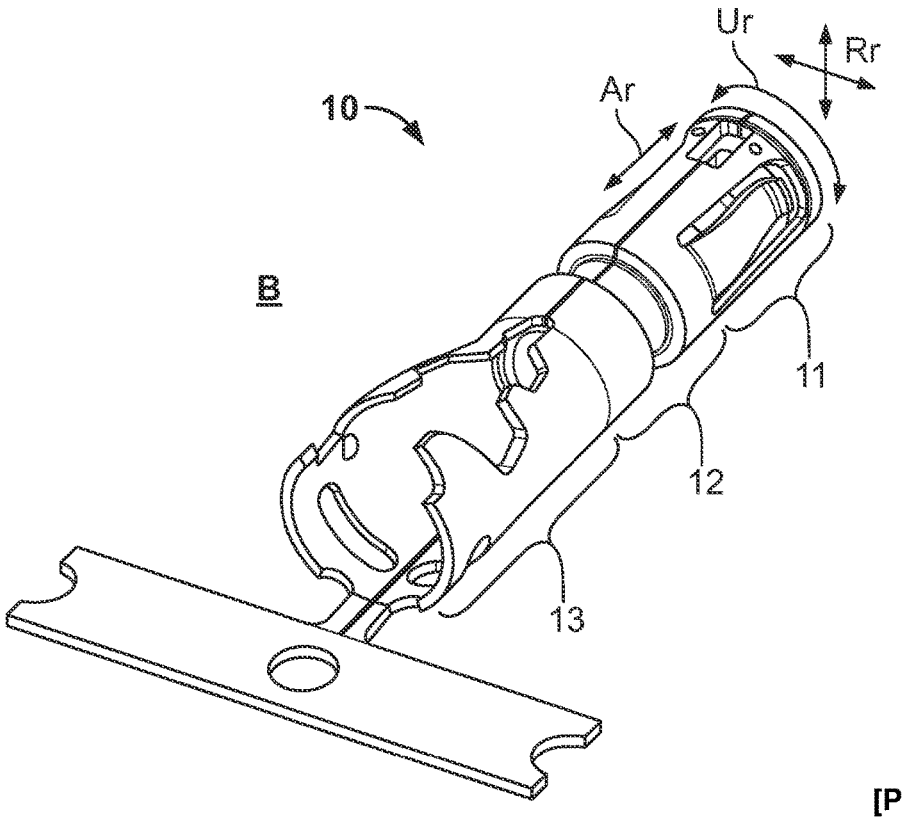
Fig. 1 [PRIOR ART]
FIG. 1 is a perspective view of a high frequency shielding contact sleeve according to the prior art.

The invention is described in greater detail below with the aid of exemplary embodiments with reference to the attached schematic and not-to-scale drawings. Sections, elements, parts, units, components and/or schemes which have an identical, like or analogue embodiment and/or function are identified by the same reference numerals in the description of the figures, the claims, and in the drawings. A possible alternative, which is not explained in the description, is not illustrated in the drawing and/or is not conclusive, a static and/or kinematic reversal, a combination etc. to the exemplary embodiments of the invention or to a component, a scheme, a unit, a component, an element or a section thereof can moreover be derived from the description of the figures.

In the case of the invention, a feature (section, element, part, unit, component, function, size etc.) can be configured in a positive manner, in other words provided, or in a negative manner, in other words not provided. In this description, claims, and drawing, a negative feature is not explicitly described as a feature if in accordance with the invention no value is attributed to the fact that it is not provided. A feature of this specification can not only be used in a specified manner but also can be used in a different manner. In particular, it is possible with the aid of a reference numeral and a feature that is allocated thereto or conversely, for a feature in the description, the claims and/or the drawing to be replaced, added or omitted in the claims and/or the description. Furthermore, as a consequence a feature can be disclosed and/or specified in greater detail in a claim.

The features of the description can also be interpreted as optional features; in other words each feature can be described as an optional feature, in other words as a non-binding feature. Thus, it is possible to separate out a feature, where appropriate including its peripherals, from one exemplary embodiment, wherein this feature can then be transferred to a generalized inventive idea. The lack of a feature (negative feature) is illustrated in an exemplary embodiment by virtue of the fact that the feature is optional with regard to the invention. Moreover, in the case of a term for a type of feature, it is also possible to simultaneously use a generic term for the feature (where appropriate broken down further into a hierarchical structure of sub-genre etc.), as a result of which it is possible, for example by taking into consideration equivalent effects and/or equivalent importance, to generalize the feature.

The invention is explained in greater detail below with reference to exemplary embodiments of an electrical terminal 10, a high frequency shielding contact sleeve 10 in an embodiment, for an electrical high frequency connecting assembly 1 for an electrical high frequency data connector 0, such as for the automotive sector. Although the invention is described and illustrated in greater detail by exemplary embodiments, the invention is not limited by the disclosed exemplary embodiments but is rather of a fundamental nature.

Other variants can be derived without abandoning the protective scope of the invention. The invention can be used generally in the electricity sector in the case of an electrical. One exception in this case is ground-based electrical power engineering. The drawings only illustrate the spatial sections of a subject matter of the invention that are necessary for understanding the invention. Reference terms such as connector and mating connector, terminal and mating terminal etc. are to be interpreted synonymously, in other words where appropriate interchangeable with one another.

Figure 2:
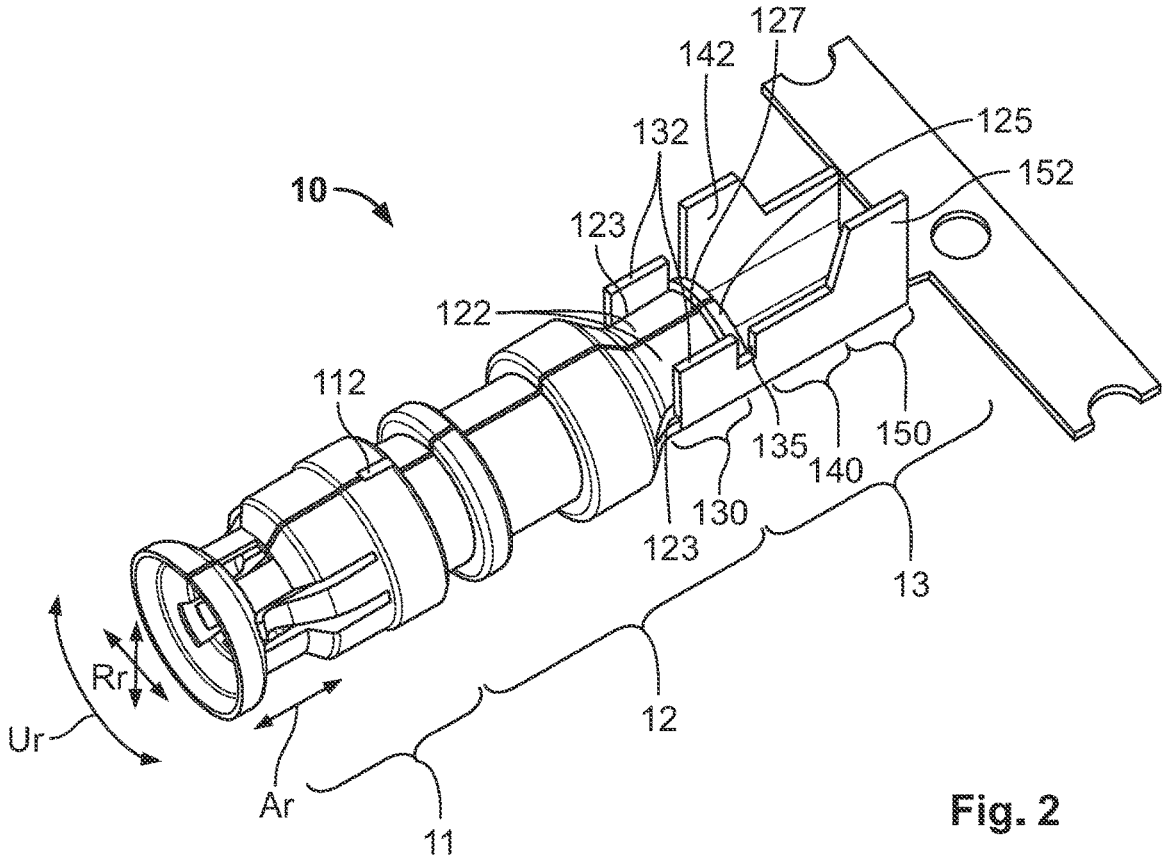
FIG. 2 is a perspective view of a high frequency shielding contact sleeve according to an embodiment.
Figure 6:
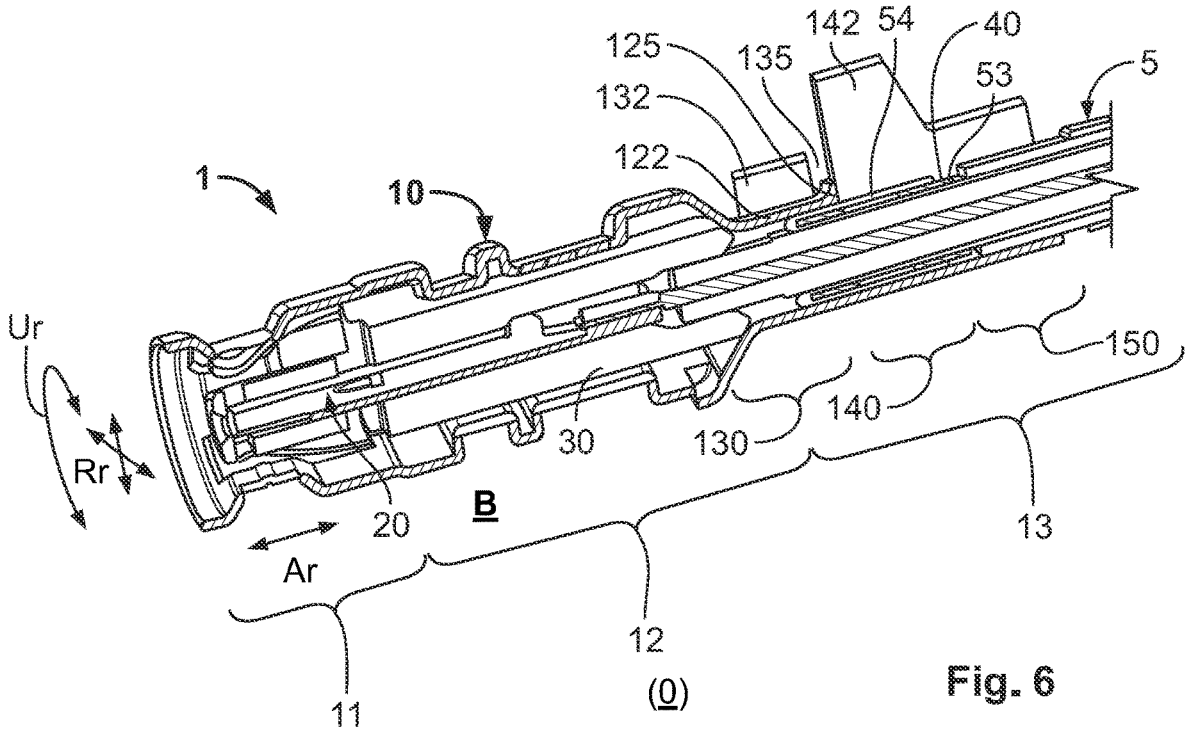
FIG. 6 is a sectional perspective view of the pre-assembled electrical cable of FIG. 5.

FIG. 2 illustrates an exemplary embodiment of the terminal 10 in accordance with the invention. The terminal 10 has a body section 11, 12 and an electro-mechanical crimping section 13. The body section 11, 12 is broken down in the present case into an electro-mechanical contacting section 11 (at a front in the axial direction Ar of the terminal 10) for contacting a mating terminal, and a mechanical attaching section 12 (middle), wherein the attaching section 12 can be used for holding/attaching the terminal 10 in a housing and/or for holding/attaching a second electrical terminal 20, in an embodiment a high frequency terminal 20 as shown in FIG. 6. It is naturally possible to omit the attaching section 12 and, when required, to integrate its functions into the contacting section 11. The terminal 10 can be embodied for example for an electrical copper and/or aluminum cable 5, and as a shielding contact sleeve in particular for a coaxial cable 5.

The terminal 10 can be embodied as a sub-assembly having an inner dielectric. In embodiments of the invention, the terminal 10 is formed in one piece of a material or integral thereto. The term "formed in one piece of the material" is understood to mean an embodiment of the terminal 10 whose individual parts are bonded to one another substance-to-substance (welded, soldered, adhered, laminated etc.) and cannot be separated into its individual parts without damaging one of its individual parts. In this case, the bond can moreover be produced by of a non-positive- and/or positive-locking connection (not in the case of an integral embodiment). The term "integral embodiment" is understood to mean an embodiment of the terminal 10 in which there is only one component that can only be separated by being destroyed. The component is manufactured from a single original piece (sheet metal, blank etc.) and/or from a single original mass (molten metal), which for its part is automatically an integral part. An inner bond is performed by adhesion and/or cohesion. In so doing, it is possible to provide an integral coating, deposition, galvanization etc.

Figure 3:
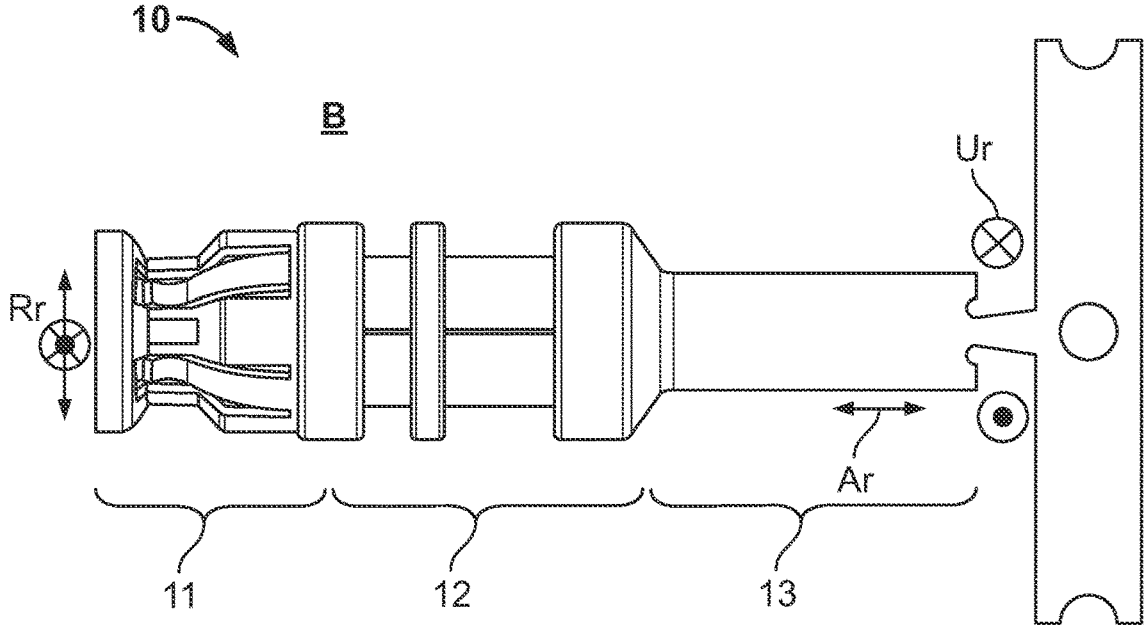
FIG. 3 is a bottom view of the shielding contact sleeve of FIG. 2.

The approximately hollow cylindrical body section 11, 12 extends in the axial direction Ar, as shown in FIGS. 2 and 3, and the walls of the body section 11, 12 run in a circumferential direct Ur about the axial direction Ar. To a rear in the axial direction Ar, the crimping section 13 of the terminal 10 adjoins the body section 11, 12, in an integral manner in an embodiment. In an embodiment, the body section 11, 12 or the attaching section 12 and the crimping section 13 overlap in the axial direction Ar or a material layer 122, (referred to below as a second material layer 122 or a reinforcing tab 122) of the terminal 10 starting from the body section 11, 12 or the attaching section 12 protrudes in the crimping section 13.

Figure 7:
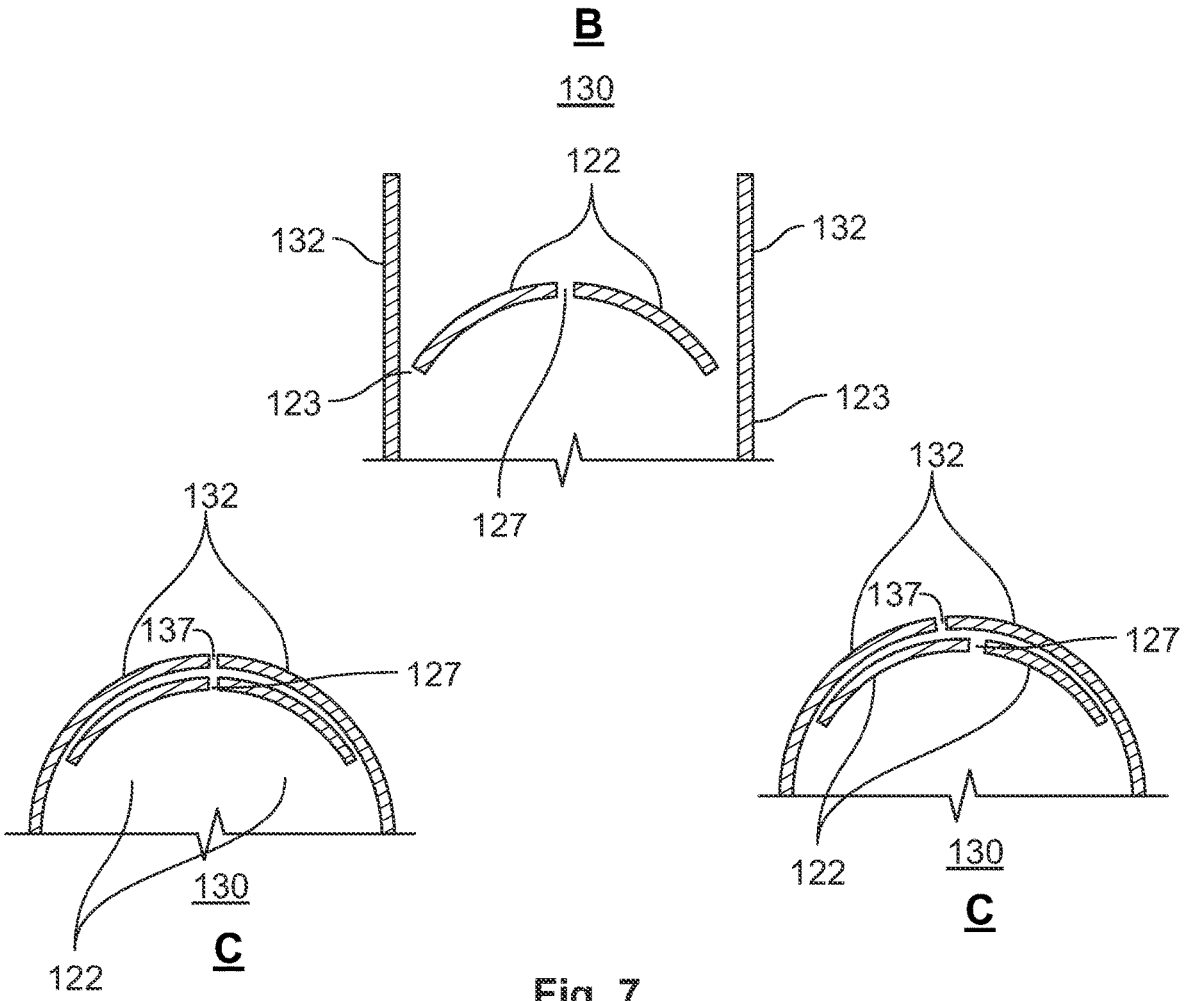
FIG. 7 is a sectional end view of a front conductor crimp region of the shielding contact sleeve of FIG. 2 in a bent state and in multiple embodiments of a crimped state.

As shown in FIG. 2, the crimping section 13 is divided into a front conductor crimp region 130, a middle conductor crimp region 140, and a rear insulation crimping region 150. Another configuration, for example by omitting the middle conductor crimp region 140 or of the insulation crimping region 150, can be used in accordance with the invention. In accordance with the invention, the conductor crimp region 130 and consequently also the crimping section 13 is embodied in such a manner that a first material layer 132 of the conductor crimp region 130 can be crimped indirectly or directly onto a second material layer 122 of the terminal 10 or of the conductor crimp region 130, as a result of which a double material layer region 122, 132 is arranged in the conductor crimp region 130, as shown in FIG. 7.

The crimping section 13 or the double material layer region 122, 132 is used to mechanically reinforce the terminal 10. In other words, in comparison to the prior art, more resistance is provided against the cable 5 being disconnected, for example in a 90° direction with respect to the longitudinal extension of the terminal 10. In the case of a coaxial cable 5, the crimping section 13 or the double material layer region 122, 132 is used to provide a 360° attachment of a shielding conductor of the coaxial cable 5 to the terminal 10. Moreover, the crimping section 13 or the double material layer region 122, 132 can be used to adapt the terminal 10 to suit cross sections of cables 5 which are of different sizes and are to be connected thereto. This is achieved for example as a diameter compensation of a thinner cable.

As shown in FIG. 2, the first material layer 132 of the conductor crimp region 130 or of the terminal 10 has at least one crimping flap 132, also referred to as at least one front conductor crimp tab 132. In the shown embodiment, two of the crimping flaps 132 are arranged on/in the terminal 10. Moreover, the second material layer 122 of the terminal 10 has at least one reinforcing tab 122, and in the shown embodiment two reinforcing tabs 122. Depending upon a shape or depending upon a state of the terminal 10, the two material layers 122, 132 each have a different shape and in each case a different position in the terminal 10 and with respect to one another in the terminal 10.

The terminal 10 has at least three shapes or states that can be quite different from one another between their production and their final assembly on an electrical cable 5, in particular a high frequency coaxial cable 5. These three shapes or states are initially a blank state R, shown in FIG. 4, a stamped-out state of a terminal 10. Following on afterwards in a chronological sequence directly or indirectly a bent state B, a state shown in FIGS. 2 to 4 (foreground) and 5 to 7 (*top*), and following on afterwards in turn in a chronological sequence directly or indirectly a crimped state C, shown in FIG. 7 (bottom).

Figure 4:
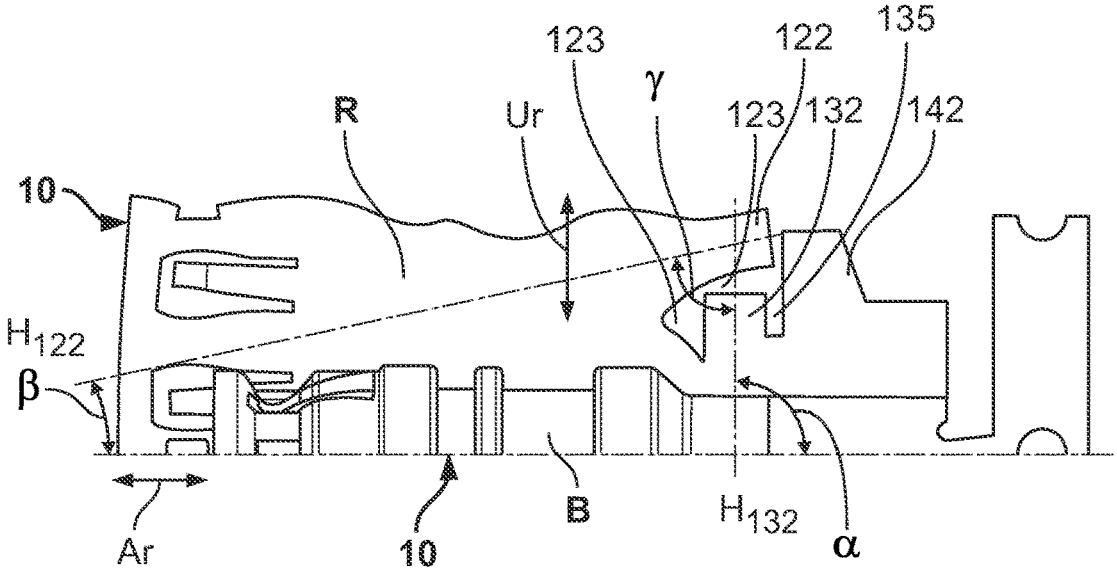
FIG. 4 is a bottom view of the shielding contact sleeve of FIG. 2 in a blank state and in a bent state.

In the flat blank state R, shown in FIG. 4, the second material layer 122 or the at least one reinforcing tab 122 is oriented in a developed circumferential direction Ur outside the first material layer 132 or the at least one front conductor crimping flap 132 in the terminal 10. In so doing, a rear axial end of the second material layer 122 or of the at least one reinforcing tab 122 extends as far as a middle conductor crimping flap 142 of the middle conductor crimping region 140 or a rear insulation crimping flap 152 of the rear insulation crimping region 150; in an embodiment, in each case, some 'clearance' is provided.

In FIG. 4 (blank state R) the angle $\alpha$ refers to an angle between a first functional main extension direction $H_{132}$ of the first material layer 132 or of the at least one front conductor crimping flap 132 and the axial direction Ar of the terminal 10. The angle $\alpha$ can be greater than 45°, 60°, 75°, 82.5° or at an angle that is fundamentally a right angle with respect to the axial direction Ar. Moreover, this can be embodied in a manner unfolded, facing away or protruding away from the crimping section 13 in the case of a bent state B of the terminal 10. Furthermore, in the case of the crimped state C of the terminal 10, this can extend fundamentally in a circumferential direction Ur of the terminal 10.

The angle $\beta$ shown in FIG. 4 refers to an angle between a second functional main extension direction $H_{122}$ of the second material layer 122 or of the at least one reinforcing tab 122 and the axial direction Ar of the terminal 10. The angle $\beta$ can be smaller than 45°, 30°, 15°, 7.5° or fundamentally parallel with respect to the axial direction Ar. Moreover, in the case of a bent state B of the terminal 10 this can be embodied in a manner protruding into the crimping section 13. Furthermore, in the case of a crimped state C of the terminal 10 this can be embodied in a manner protruding into the crimping section 13.

Furthermore, the angle $\gamma$ refers to an angle between the functional main extension direction $H_{132}$ of the first material layer 132 or of the at least one front conductor crimping flap 132 and the functional main extension direction $H_{122}$ of the second material layer 122 or of the at least one reinforcing tab 122. The angle $\gamma$ can be greater than 45°, 60°, 75°, 82.5° or can be arranged at a fundamentally right angle with respect to one another. Moreover, in the case of a bent state B of the terminal 10 and in the case of a straight projection into a lateral axial plane of the terminal 10, these can include an angle greater than 45°, 60°, 75°, 82.5° or they can be arranged at a fundamentally right angle with respect to one another. Furthermore, these can in the case of a crimped state C of the terminal 10 and in the case of a straight projection into a base axial plane of the terminal 10 include an angle greater than 45°, 60°, 75°, 82.5° or be arranged at a fundamentally right angle with respect to one another.

Figure 5:
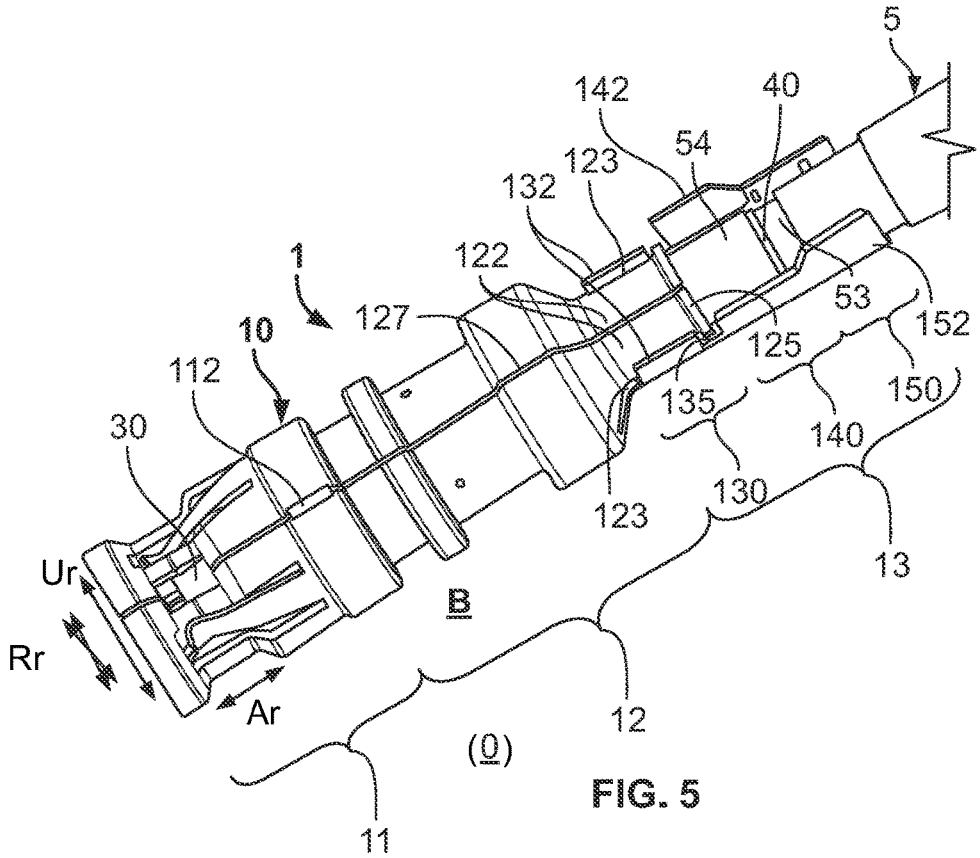
FIG. 5 is a perspective view of a pre-assembled electrical cable according to an embodiment not yet in a crimped state.

In order to produce the bent state B in which the terminal 10 has been bent to shape, as shown in FIGS. 2, 5 and 6, starting from the blank state R, the second material layer 122 or the at least one reinforcing tab 122 is bent over the first material layer 132 or the at least one front conductor crimping flap 132 inwards into the terminal 10. In so doing, at least one lateral axial slot 123 that is embodied as a through-going slot is produced in the terminal 10 and the axial slot 123 separates the second material layer 122 from the first material layer 132 in a mechanically functional manner. The lateral axial slot 123 can extend in this case into the body section 11, 12 or into the attaching section 12. In so doing, in an embodiment, two reinforcing tabs 122 are positioned between two front conductor crimping flaps 132, thus producing two lateral axial slots 123.

The lateral axial slot 123 can be delimited in the case of a blank state R from a free circumferential end of the conductor crimping flap 132 and an axial region of the reinforcing tab 122, as shown in FIG. 4. Moreover, in the case of a bent state B of the terminal 10, the (lateral) axial slot 123 can be delimited from an inner face of the conductor crimping region 130 and a circumferential end of the reinforcing tab 122 which is directly adjacent to this inner face, as shown in FIGS. 2 and 5. Furthermore, the lateral axial slot 123 can start in a material of the body section 11, 12 or of the attaching section 12 of the terminal 10 and can open in the crimping section 13 or in a longitudinal end section of the conductor crimping region 140.

In an embodiment, the lateral axial slot 123 is arranged on two axial sides of the terminal 10 which lie fundamentally diametrically opposite one another, (orientation for example in accordance with FIGS. 2 and 5). The opening of the lateral axial slot 123 can lie at a transition from a front conductor crimping region 130 to a middle conductor crimping region 140 (for example height of the through-going slot for the collar 125) or another crimping region.

In the bent state B, the at least one reinforcing tab 122 then extends starting from the body section 11, 12 or the attaching section 12 in the axial direction Ar to the rear into the crimp section 13 or the front conductor crimping region 130, as shown in FIG. 2. In this embodiment, two reinforcing tabs 122 are oriented in such a manner that the reinforcing tabs 122 are arranged adjacent to one another in the circumferential direction Ur above an upper axial slot 127 that is embodied as a through-going slot. In the axial direction Ar at least approximately at the same height, the conductor crimping flaps 132 are arranged laterally adjacent thereto and opposite one another fundamentally parallel to one another in the radial direction Rr of the terminal 10. Moreover, for the bent state B, at least the middle conductor crimping flap 142 and at least the rear insulation crimping flap 152 are arranged with their walls that correspond thereto and are complementary therewith.

In order to produce the crimped state C in which the terminal 10 is crimped, as shown in the bottom views of FIG. 7, starting from the bent state B, the first material layer 132 or the at least one front conductor crimping flap 132 is bent in the circumferential direction Ur and the radial direction Rr inwards onto the second material layer 122 or the at least one reinforcing tab 122. In the crimped state C, the second material layer 122 forms in the radial direction Rr an inner region and the first material layer 132 forms in the radial direction Rr an outer region of a double material layer region 122, 132 of the crimped terminal 10.

In so doing, the material layers 122, 132 can be arranged one above the other indirectly or directly in the radial direction Rr. In the first case, a third section or region is crimped between the material layers 122, 132, and in the second case the material layers 122, 132 lie directly one above the other, as shown in the bottom views of FIG. 7. Moreover, the first material layer 132 or the at least one front conductor crimping flap 132 presses the second material layer 122, which can move, in particular pivot, in the radial direction Rr, or the at least one reinforcing tab 122 in the radial direction Rr inwards onto a high frequency coaxial cable 5 shown in FIGS. 5 and 6.

The double material layer region 122, 132 is used at least as the front conductor crimping region 130 or exclusively as a conductor crimping region 130 of the terminal 10, as shown in FIG. 2. As illustrated, it is possible for the middle conductor crimping region 140 to adjoin the front conductor crimping region 130 to the rear in the axial direction Ar, wherein the two conductor crimping regions 130, 140 can crimp an outer conductor 53 of the high frequency coaxial cable 5 onto a support sleeve 40 of the outer conductor 53, as shown in FIGS. 5 and 6. Other configurations can naturally be used. The insulation crimping region 150 with its rear insulation crimping flap 152 adjoins the single conductor crimping region 130 or the middle conductor crimping region 140 to the rear in the axial direction Ar. The double material layer region 122, 132 can be embodied as at least one conductor crimping 130, 140 region or as exclusively a conductor crimping region of the terminal or of the crimping section. Furthermore, the double material layer region 122, 132 can be embodied in sections as an insulation crimping region 150.

In the embodiment shown in FIG. 2, the front conductor crimping region 130 has two front conductor crimping flaps 132 and two reinforcing tabs 122 that originate from the body section 11, 12 or from the attaching section 12 and protrude therein. Furthermore, the middle conductor crimping region 140 has a single (middle) conductor crimping flap 142 and lying opposite in the radial direction Rr a wall of the conductor crimping region 140, said wall being complementary thereto for the crimped state C. Furthermore, the (rear) insulation crimping region 150 has a single insulation crimping flap 152 and lying opposite in the radial direction Rr a wall of the insulation crimping region 150, said wall being complementary thereto for the crimped state C. In so doing, the middle conductor crimping flap 142 and the rear insulation crimping flap 152 are arranged in the radial direction Rr diagonally opposite in the crimping section 13. Starting from the bent state B, the conductor crimping flap 142 of the middle conductor crimping region 140 can be bent onto a crimping wall of the middle conductor crimping region 140 which lies opposite in the radial direction. In so doing, edges that lie adjacent to one another, in particular axial edges, of the middle conductor crimping flap 142 and the crimping wall lie in a positive locking manner and adjacent to one another above a narrow slot. This can apply additionally or alternatively to the insulation crimping flap 152.

In an embodiment, in the crimped state C, a through-going slot 135 is arranged between the at least one closed, front conductor crimping flap 132 and the closed middle conductor crimping flap 142 that lies to the rear in the axial direction Ar. A collar 125 of the at least one reinforcing tab 122 is positioned in this through-going slot 135 as the terminal 10 is changed from the bent state B into the crimped state C, as shown in FIG. 2. In so doing, the collar 125 is embodied as a free longitudinal end-side collar 125 that protrudes in the radial direction Rr outwards. The collar 125 can also be embodied as a band etc. The collar 125 can be received in a positive-locking manner in the through-going slot 135; in an embodiment, the collar 125 is received with a fundamentally total circumferential dimension in the through-going slot 135.

In an embodiment, the terminal 10 is configured in such a manner that in the crimped state C only a narrow slot and, in an embodiment no overlap, exists between: a rear axial edge (extending in the circumferential direction Ur) of the front conductor crimped region 130 and the collar 125 or another front axial edge, a front axial edge (extending in the circumferential direction Ur) of the middle conductor crimping region 140 and the collar 125 or another rear axial edge, and/or the edges of two conductor crimping flaps 132 that lie opposite one another in the circumferential direction Ur, an upper axial crimping slot 137.

This can apply in a similar manner for a circumferential edge (extending exclusively in the axial direction Ar in an embodiment) of the middle conductor crimping flap 142 and a relevant circumferential edge of a wall of the middle conductor crimping region 140 that lies opposite in the circumferential direction Ur, a circumferential edge (extending exclusively in the axial direction Ar in an embodiment) of the (rear) insulation crimping flap 152 and a relevant circumferential edge of a wall of the (rear) insulation crimping region 150 that lies opposite in the circumferential direction Ur, and/or two mutually relevant edges (extending in the axial direction Ar, or in the axial direction Ar and the circumferential direction Ur) of the middle conductor crimping flap 142 and the rear insulation crimping flap 152.

The (upper) axial crimping slot 137 can, as its name suggests, align in the crimped state C, in all relevant embodiments, with for example two conductor crimping flaps 132, fundamentally with the upper axial slot 127 of the two reinforcing tabs 122 in the radial direction Rr, as shown in FIG. 7. It is also possible that the (upper) axial crimping slot 137 is arranged in the circumferential direction Ur offset with respect to the upper axial slot 127 of the two reinforcing tabs 122, as shown in FIG. 7. In the latter case, the two conductor crimping flaps 132 are embodied in particular with different lengths.

The connecting assembly 1 in accordance with the invention comprises the electrical terminal 10, in particular an electrical shielding contact sleeve in accordance with the invention, and a second electrical terminal. If the terminal 10 is embodied for example as a shielding contact sleeve, then it receives a second electrical terminal, for example in the form of a pin terminal, a peg terminal, a tab terminal, a female connector terminal etc. by way of a dielectric. In so doing, the connecting assembly 1 can be embodied as a coaxial connecting assembly. In an embodiment, the second terminal is in one piece as far as the material is concerned or integral thereto. The connector 0 comprises a connector housing, an electrical terminal 10 and/or an electrical connecting assembly 1.

An electrical entity in accordance with the invention comprises the electrical terminal 10, an electrical connecting assembly 1 and/or an electrical connector 0. In so doing, the entity can comprise, for example in addition to an entity housing, moreover at least one mechanical, electrical, electronic, optical and/or fluidic apparatus or assembly. Such an entity can be embodied for example (also) as an electrical apparatus, an electrical assembly, a pre-assembled electrical cable, an electrical assembly, an electrical printed circuit board, an electrical component, an electrical module, an electrical device, an electrical appliance, an electrical unit, an electrical installation, an electrical system etc.

The entity, for example, can be a pre-assembled electrical cable for example a connecting assembly 1 having a shielding contact sleeve 10 as a first terminal, and an electrical cable 5 that is attached to the connecting assembly 1. FIGS. 5 and 6 illustrate the pre-assembled electrical coaxial cable in a state immediately prior to the terminal 10 being crimped onto the coaxial cable 5. In so doing, the second high frequency terminal 20 that in the present case is embodied as a high frequency female connector terminal 20 is already assembled within the terminal 10 by way of a dielectric 30. In so doing, the support sleeve 40 is assembled on the outside of the outer conductor 53, for example crimped, wherein moreover a free longitudinal end section 54 of the outer conductor 53 is placed around or wound around the support sleeve 40 (optional).

In the present case, the terminal 10 is embodied is such a manner and the coaxial cable 5 is prepared in such a manner that the front conductor crimping flaps 132 can be crimped onto a front section of the support sleeve 40 and, in an embodiment, also onto a cable section that adjoins thereto to the front without a support sleeve 40. Moreover, the middle conductor crimping flap 142 can be crimped fundamentally with its entire axial extension onto the support sleeve 40. In a similar manner to the front conductor crimping flap 132, it is possible that the middle conductor crimping flap 142 can also be crimped onto a cable section that adjoins the support sleeve 40 to the rear. The insulation crimping flap 152 can be crimped onto an outer insulation of the coaxial cable 5.

The terminal 10 is robust, for example with respect to disconnecting the electrical cable 5, which is connected thereto in an electro-mechanical manner, for example in a 90° direction with respect to the longitudinal extension of the terminal 10. Moreover, a good connection of a shielding conductor of the cable 5 to the terminal 10 is ensured for the case that the terminal 10 is embodied as a shielding conductor sleeve. Furthermore, it is to be possible to produce the terminal 10 and the connector 0, in comparison to it later use, in a cost-effective manner, and they are to be of a simple construction and/or simple to handle.

The lateral axial slots 132 in a transition region between the body section 11, 12 (contacting section and where appropriate attaching section) or the attaching section 12 of the terminal and its crimping region 130, reduce the mechanical stresses during a reshaping procedure of the terminal 10, in particular during a crimping procedure of the terminal 10. This can lead to the same interface and the same layout of the terminal 10 for different cross-sections of cables 5. In accordance with the invention, only a single conversion kit is required for the crimping region 130. The prior art, shown in FIG. 1, does not have any slots in the transition region between the body section 11, 12 of the terminal 10 and its crimping region 13 and consequently does not have a double material layer region, which requires a costly layout for conversion kits for other cross-sections of cables.

What is claimed is:

1. An electrical terminal, comprising:

a contacting section; and a crimping section arranged to a rear of the contacting section in an axial direction of the terminal, a first material layer of the crimping section is crimped directly onto a second material layer of the terminal or of the crimping section in a crimped state, forming a double material layer region and a through-going slot.

2. The electrical terminal of claim 1, wherein the first material layer and the second material layer are arranged one above the other in a radial direction of the terminal, the double material layer region is in a conductor crimping region of the crimping section.

3. The electrical terminal of claim 2, wherein the double material layer region is in an insulation crimping region of the crimping section.

4. The electrical terminal of claim 2, wherein the conductor crimping region has a pair of reinforcing tabs arranged above an upper axial slot and adjacent to one another in a circumferential direction and a pair of conductor crimping flaps crimpable onto one another in the circumferential direction, the reinforcing tabs and the conductor crimping flaps overlap in the crimped state.

5. The electrical terminal of claim 1, wherein the first material layer is a crimping flap attached to the crimping section.

6. The electrical terminal of claim 5, wherein the second material layer is a reinforcing tab attached to an attaching section disposed between the contacting section and the crimping section.

7. The electrical terminal of claim 6, wherein an axial slot is arranged between the first material layer and the second material layer.

8. The electrical terminal of claim 7, wherein the axial slot is delimited in a blank state of the terminal from a free circumferential end of the crimping flap and an axial region of the reinforcing tab, and/or in a bent state of the terminal is delimited from an inner face of a conductor crimping region and a circumferential end of the reinforcing tab that is directly adjacent to the inner face.

9. The electrical terminal of claim 7, wherein the axial slot starts in a body section and opens in the crimping section.

10. The electrical terminal of claim 6, wherein a middle conductor crimping flap adjoins the first material layer to the rear in the axial direction.

11. The electrical terminal of claim 10, wherein the through-going slot is arranged between the first material layer and the middle conductor crimping flap and a collar of the reinforcing tab engages in the through-going slot in the crimped state, the collar protrudes outwards in a radial direction and is provided in a middle section or a free longitudinal end section of the reinforcing tab.

12. The electrical terminal of claim 10, wherein the crimping section has an insulation crimping flap on an end section to the rear in the axial direction, the insulation crimping flap and the middle conductor crimping flap are arranged adjacent to one another in the axial direction in the crimped state.

13. The electrical terminal of claim 1, wherein a first functional main extension direction of the first material layer and a second functional main extension direction of the second material layer are arranged at an angle greater than 45 degrees with respect to one another in a blank state of the terminal, in a bent state of the terminal, and/or in a crimped state of the terminal.

14. The electrical terminal of claim 1, wherein the terminal is formed in one piece of a material.

15. The electrical terminal of claim 1, wherein the terminal is a sub-assembly having an inner dielectric.

16. An electrical connecting assembly, comprising:

a first electrical terminal including a contacting section, a crimping section arranged to a rear of the contacting section in an axial direction of the terminal and a body section in between the contacting section and the crimping section, a first material layer of the crimping section is crimped directly onto a second material layer of the terminal or of the crimping section in a crimped state, forming a double material layer region; and a second electrical terminal matable with the first electrical terminal.

17. An electrical connector, comprising:

a connector housing; and an electrical terminal disposed in the connector housing, the electrical terminal including a contacting section and a crimping section arranged to a rear of the contacting section in an axial direction of the terminal, a first material layer of the crimping section is crimped directly onto a second material layer of the terminal or of the crimping section in a crimped state, forming a double material layer region and a first functional main extension direction of the first material layer and a second functional main extension direction of the second material layer are arranged at an angle greater than 45 degree with respect to one another in a blank state of the terminal, in a bent state of the terminal, and/or in a crimped state of the terminal.

18. An electrical entity, comprising:

an electrical terminal including a contacting section and a crimping section arranged to a rear of the contacting section in an axial direction of the terminal, a first material layer of the crimping section is crimped directly onto a second material layer of the terminal or of the crimping section in a crimped state, forming a double material layer region;

a support sleeve assembled on the electrical cable in a radial direction below a reinforcing tab of the second material layer;

a collar of the reinforcing tab is received in the axial direction between a crimping flap of the first material layer and a middle conductor crimping flap; and an electrical cable attached to the electrical terminal.

19. The electrical entity of claim 18, wherein the support sleeve is crimped in the axial direction by the crimping flap of the first material layer.

20. The electrical entity of claim 19, wherein the support sleeve is crimped in the axial direction by the middle conductor crimping flap adjoining the crimping flap of the first material layer to the rear in the axial direction.

* * * * *